US012207712B1

(12) United States Patent
Weld

(10) Patent No.: US 12,207,712 B1
(45) Date of Patent: Jan. 28, 2025

(54) RELEASABLE RING

(71) Applicant: William P. Weld, Rowlett, TX (US)

(72) Inventor: William P. Weld, Rowlett, TX (US)

( * ) Notice: Subject to any disclaimer, the term of this patent is extended or adjusted under 35 U.S.C. 154(b) by 0 days.

(21) Appl. No.: 18/142,158

(22) Filed: May 2, 2023

Related U.S. Application Data

(60) Provisional application No. 63/337,970, filed on May 3, 2022.

(51) Int. Cl.
*A44C 9/02* (2006.01)
*A44C 9/00* (2006.01)

(52) U.S. Cl.
CPC ..... *A44C 9/0038* (2013.01)

(58) Field of Classification Search
CPC ..... A44C 9/0038; A44C 9/0046; A44C 9/00; A44C 9/0007; A44C 9/0015; A44C 9/0023; A44C 9/02
USPC ..... 63/15.45, 15.65
See application file for complete search history.

(56) References Cited

U.S. PATENT DOCUMENTS

| | | | | |
|---|---|---|---|---|
| 3,017,754 | A * | 1/1962 | Manne | A44C 9/02 29/441.1 |
| 7,963,289 | B1 * | 6/2011 | King | A45D 8/34 132/106 |
| 10,506,852 | B2 * | 12/2019 | Serfass | A44C 5/0007 |
| 2019/0166962 | A1 * | 6/2019 | Stephens | A44C 9/0038 |
| 2020/0390203 | A1 * | 12/2020 | Sana | A44C 5/0092 |
| 2022/0218077 | A1 * | 7/2022 | Elinski | A44C 13/00 |

* cited by examiner

*Primary Examiner* — Jack W Lavinder
(74) *Attorney, Agent, or Firm* — Kenneth L. Tolar

(57) ABSTRACT

A releasable ring includes an annulus formed of a pair of semicircular segments, each having a pair of opposing ends. A connector removably joins the opposing ends of a first segment with the opposing ends of the second segment to form a continuous ring band that is placed around a wearer's finger. When a predetermined amount of force is applied to the band, the two segments freely separate, thereby preventing avulsion injuries.

8 Claims, 4 Drawing Sheets

RELEASABLE RING

CROSS REFERENCE TO RELATED APPLICATIONS

This application claims priority of provisional application No. 63/337,970 filed on May 3, 2022, the specification of which is incorporated herein by reference.

BACKGROUND OF THE INVENTION

The present disclosure relates to a ring having a band that releases when subjected to a predetermined amount of force to prevent avulsion injuries.

DESCRIPTION OF THE PRIOR ART

Rings have been one of the most commonly worn jewelry items for centuries. Rings typically are worn to confirm a marriage, to enhance a wardrobe or to commemorate a specific religion or accomplishment. However, wearing a ring is inherently dangerous since the band can easily cling to moving objects or machinery. If so, the ring can be suddenly ripped from the wearer's finger, causing various ring-avulsion injuries, such as internal soft-tissue damage, degloving, and even finger amputations. Though a wearer can remove the ring before engaging in risky activity, such practice often results in lost or misplaced rings. Furthermore, because a ring is often a somewhat permanent adornment, remembering to remove it prior to risky activity is difficult.

People who are at higher risk for avulsion injuries often wear silicone ring bands, which break before causing a ring avulsion injury. However, silicone ring bands have numerous disadvantages. They wear out quickly and must be frequently replaced. Furthermore, they are uncomfortable and aesthetically unappealing. Moreover, they attract dirt, debris, and pet hair, thereby requiring frequent cleaning.

Accordingly, there is currently a need for a ring that will not cause avulsion injuries while overcoming the numerous disadvantages associated with silicone ring bands. The present invention addresses this need by providing a metallic ring band formed of two segments that are joined by resilient but frangible connectors that separate when subjected to a predetermined amount of force.

SUMMARY OF THE INVENTION

A releasable ring band includes an annulus formed of a pair of semicircular segments, each having a pair of opposing ends. A connector removably joins the opposing ends of a first segment with the opposing ends of the second segment to form a continuous ring band that is placed around a wearer's finger. When a predetermined amount of force is applied to the band, the connectors shear, allowing the two segments to freely separate, thereby preventing avulsion injuries.

An embodiment of the present invention provides a ring band that prevents avulsion injuries when suddenly ripped from a wearer's finger.

Another embodiment of the present invention provides a ring band that releases from a wearer's finger when subjected to a predetermined amount of force.

Yet another embodiment of the present invention provides a releasable ring band having a simple, easily constructed connection mechanism.

Other objects, features, and advantages of the present invention will become readily apparent from the following detailed description of the preferred embodiment when considered with the attached drawings and the appended claims.

DESCRIPTION OF THE PREFERRED EMBODIMENT

Figures 1, 2, 3:
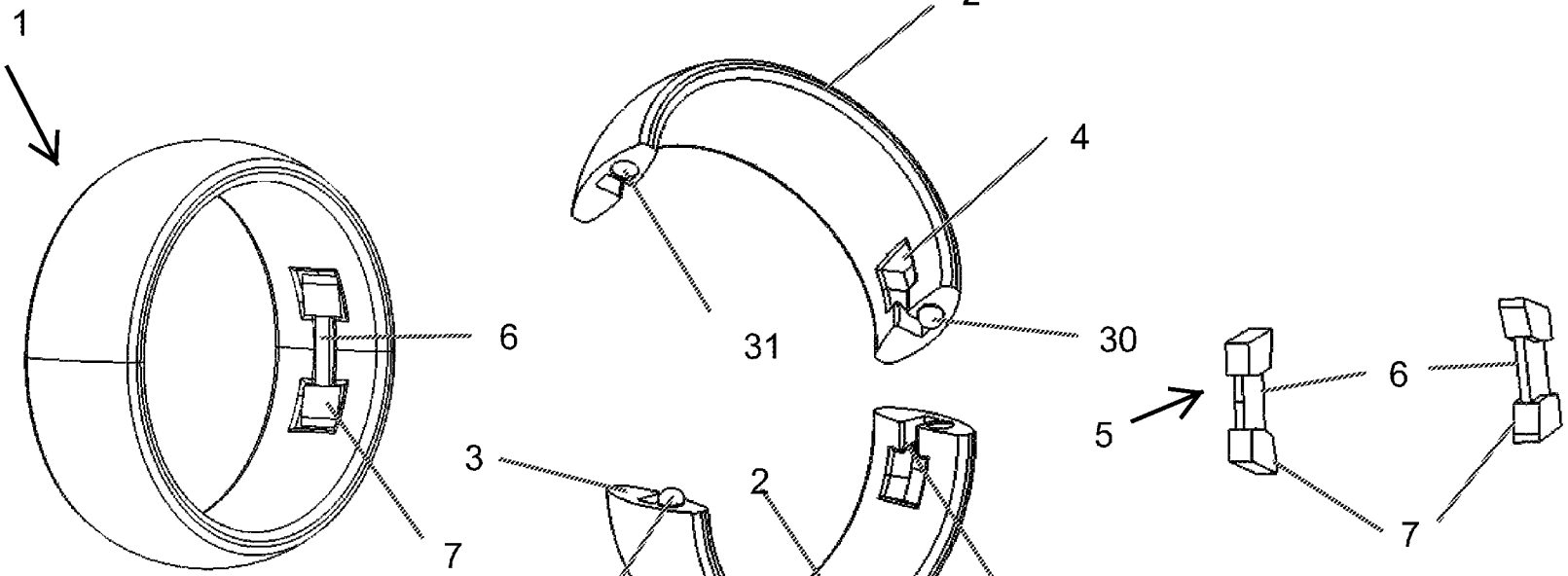
FIG. 1 is a perspective view of the releasable ring band according to an embodiment of the invention.
FIG. 2 depicts the ring band separated into the two segments.
FIG. 3 is an isolated view of the connectors.

A releasable ring band includes an annulus 1 formed of a pair of semicircular segments 2, each having a pair of opposing ends 3. The opposing ends of a first segment are releasably joined with the opposing ends of the second segment to form a continuous ring band that is placed around a wearer's finger.

In one embodiment, the means for releasably joining the two segments may include a cavity 4 at each of opposing ends of each segment that is configured to receive a mating connector 5 to join the two segments. The connector may include an arcuate stem 6 having a wide-profile tooth 7 at each end. The cavity includes a narrow passageway 8 in communication with a pocket 9 for receiving the stem 6 and tooth 7 respectively. The couplings are constructed with a resilient but frangible material that shears or breaks upon the application of a predetermined amount of force. For example, studies have shown that skin tears upon the application of a force of approximately 80N. Therefore, the connector should break upon application of a force slightly less than 80N to release the band prior to tearing the skin.

Each segment further includes a spherical, bulbous alignment pin 30 adjacent one of the cavities and a mating receptacle 31 adjacent the other cavity. The pins 30 and mating receptacles 31 allow a user to properly align the two segments prior to inserting the connectors into their respective cavities.

Figure 7:
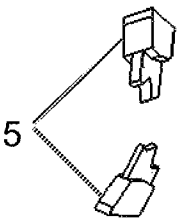
FIG. 7 is an isolated view of a connector sheared in half when releasing the two segments.
Figure 6:
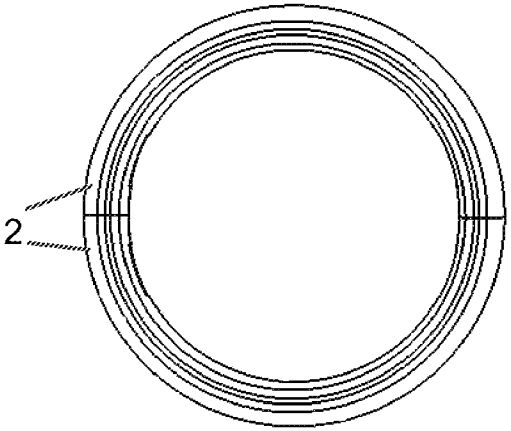
FIG. 6 is a front, plan view of the releasable band with the two segments assembled for use.
Figure 5:
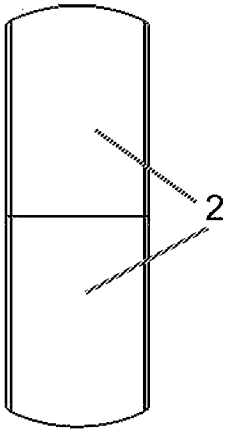
FIG. 5 is a side view of the releasable band with the two segments assembled for use.
Figure 4:
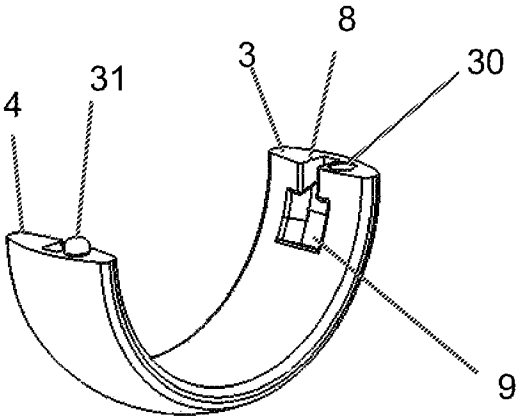
FIG. 4 is an isolated view of a single band segment.
Figure 8:
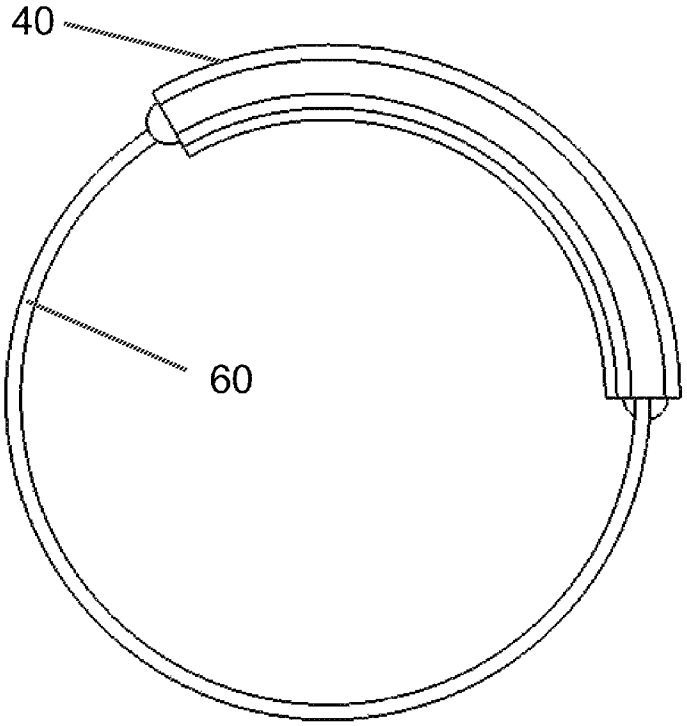
FIG. 8 depicts a second embodiment of the releasable ring.
Figure 9:
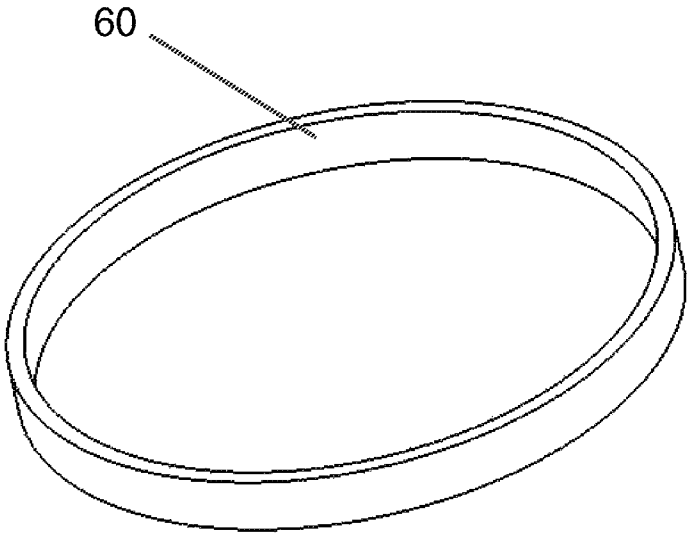
FIG. 9 is an isolated view of the retaining cincture.
Figure 10:
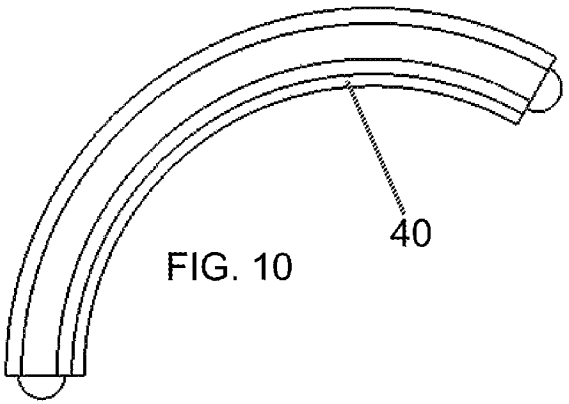
FIG. 10 is an isolated, side view of an exemplary segment according to the second embodiment.
Figure 11:
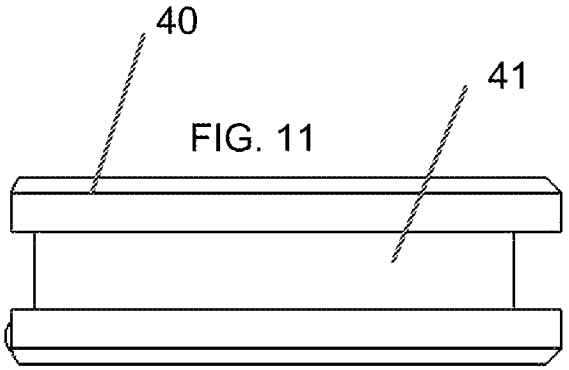
FIG. 11 is an isolated, bottom view of an exemplary segment according to the second embodiment.
Figure 12:
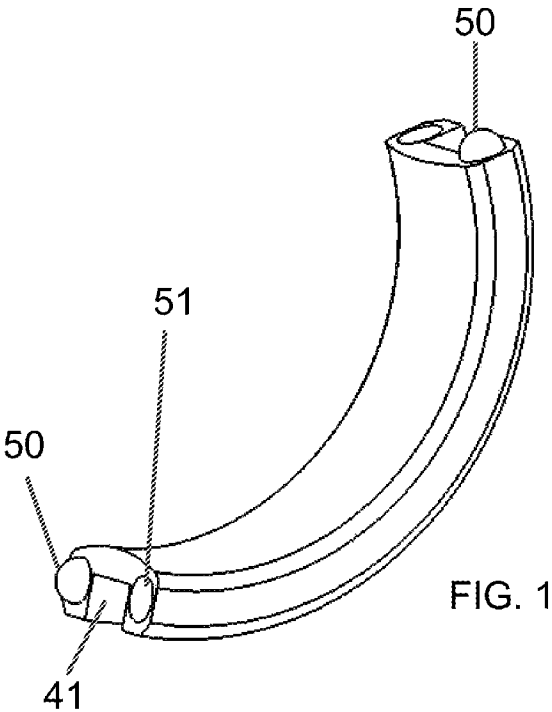
FIG. 12 is an isolated, perspective view of an exemplary segment according to the second embodiment.

To join the two segments to form a band, a user inserts a connector 5 into each cavity 4 on the segment ends to be joined, with the tooth 7 received within the pocket 9 and the stem resting within the passageway 8. The ring can then be worn in a conventional fashion. When a predetermined amount of force is applied to the band, such as when caught on an object, the connector 5 breaks in half as shown in FIG. 7, allowing the two band segments to freely separate.

Now referring to FIGS. 8-12, another embodiment of the releasable ring includes a plurality of arcuate segments 40 that cooperatively join to form a continuous ring band. Each segment includes an outer surface, an inner surface, and a pair of opposing ends. A groove 41 extends along the entire circumference of the outer surface from one end to the opposing end. Each end of the segment includes a spherical, bulbous alignment pin 50 adjacent one of side of the groove and a mating receptacle 51 adjacent the other side. Accordingly, multiple segments are joined end-to-end to form a continuous ring band that encircles the wearer's finger.

The embodiment further includes a cincture 60 formed of a frangible or brittle material that shears or separates upon the application of a predetermined amount of force. The cincture 60 encircles the conjoined ring segments and is positioned within the aligned grooves 41 to form a continuous ring band. If a predetermined amount of force is applied to the ring band, the cincture shears to release the ring segments from the wearer's finger.

The above-described device is not limited to the exact details of construction and enumeration of parts provided herein. Preferably, the band segments are constructed with gold, silver, or any other conventional jewelry metal to resemble authentic jewelry. The connectors are preferably constructed with a rigid but brittle material, such as silicone or a similar equivalent. However, the size, shape, and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims, and not any exemplary language set forth herein.

The invention claimed is:

1. A releasable ring comprising:

a continuous band formed of a first segment having a pair of opposing ends and a second segment having a pair of opposing ends;

means for releasably joining the pair of opposing ends of the first segment with the pair of opposing ends of the second segment to form a continuous ring band that is placed around a wearer's finger;

a spherical, bulbous alignment pin adjacent a cavity at one of the opposing ends and a mating receptacle adjacent a cavity at another of said opposing ends of each of said first segment and said second segment that allows a user to properly align the first segment and the second segment prior to joining the pair of opposing ends of the first segment with the pair of opposing ends of the second segment.

2. The releasable ring according to claim 1 wherein said means for releasably joining the pair of opposing ends of the first segment with the pair of opposing ends of the second segment comprises:

said cavity at each of the opposing ends of said first segment and said second segment;

a connector adapted to fit within said cavity.

3. The releasable ring according to claim 2 wherein said connector includes an arcuate stem having a wide-profile tooth at each of two ends.

4. The releasable ring according to claim 2 wherein said connector is constructed with a resilient but frangible material that shears or breaks upon the application of a predetermined amount of force.

5. The releasable ring according to claim 2 wherein said cavity includes a narrow passageway for receiving said stem and a pocket for receiving said tooth.

6. A releasable ring comprising:

a continuous band formed of a first segment having a pair of opposing ends and a second segment having a pair of opposing ends;

means for releasably joining the pair of opposing ends of the first segment with the pair of opposing ends of the second segment to form a continuous ring band that is placed around a wearer's finger, wherein said means comprises a groove circumferentially extending along an outer surface of said first segment and said second segment; and a cincture encircling said first segment and said second segment and received within said groove.

7. The releasable ring according to claim 6 wherein said cincture is formed of a frangible or brittle material that shears or separates upon the application of a predetermined amount of force.

8. The releasable ring according to claim 6 wherein each of said first segment and said second segment includes a spherical, bulbous alignment pin adjacent the groove at one of the opposing ends and a mating receptacle adjacent the groove at another of said opposing ends that allow a user to properly align the first segment and the second segment prior to positioning said cincture around said first segment and said second segment.

* * * * *